US006595333B2

(12) United States Patent
Tremblay et al.

(10) Patent No.: US 6,595,333 B2
(45) Date of Patent: Jul. 22, 2003

(54) RAIL BRAKE

(76) Inventors: Ron Tremblay, R. R. #2 P.O., Kaministiquia Ontario (CA), P0T 1X0; Stephen Hamer, R. R. #2 P.O., Kaministiquia Ontario (CA), P0T 1X0

( * ) Notice: Subject to any disclaimer, the term of this patent is extended or adjusted under 35 U.S.C. 154(b) by 0 days.

(21) Appl. No.: 09/895,396

(22) Filed: Jul. 2, 2001

(65) Prior Publication Data

US 2002/0005322 A1 Jan. 17, 2002

(51) Int. Cl.[7] ..... B61H 7/00
(52) U.S. Cl. ..... 188/41
(58) Field of Search ..... 188/41, 165, 42, 188/48, 62, 72.4, 82.1, 235

(56) References Cited

U.S. PATENT DOCUMENTS

| | | | | | |
|---|---|---|---|---|---|
| RE3,790 E | * | 1/1870 | Allen | 188/41 |
| 432,515 A | * | 7/1890 | Dederick | 188/41 |
| 794,862 A | * | 7/1905 | Hattery | 188/41 |
| 866,904 A | * | 9/1907 | Allenbrand | 188/41 |
| 1,008,795 A | * | 11/1911 | De Vito | 188/41 |
| 2,034,815 A | * | 3/1936 | Huguenin | 188/41 |
| 2,519,888 A | * | 8/1950 | Conner | 188/41 |
| 3,581,671 A | * | 6/1971 | Hart | 105/72.2 |
| 4,067,259 A | * | 1/1978 | Ames et al. | 105/26.1 |

* cited by examiner

*Primary Examiner*—Christopher P. Schwartz
*Assistant Examiner*—Xuan Lan Nguyen
(74) *Attorney, Agent, or Firm*—Ryan W. Dupris; Adrian D. Battison; Michael R. Williams

(57) ABSTRACT

A braking system is provided for rail equipment supported for rolling movement on the rails of a railway. The braking system includes a pair of braking elements arranged to be supported laterally spaced apart on the rail equipment for engaging the respective rails of the railway. Each braking element includes an upper brake block for selectively engaging a top side and a side brake block for selectively engaging an inner side of the corresponding rail. Actuators are provided for urging the braking elements downward and outward in relation to the rail equipment. The actuators engage the braking elements with the respective rails to provide a wedging action between respective inner sides of the rails. This arrangement provides considerable braking force using a relatively simple construction.

15 Claims, 3 Drawing Sheets

RAIL BRAKE

FIELD OF THE INVENTION

The present invention relates to a braking system for rail equipment of the type which is supported for rolling movement on the rails of a railway.

BACKGROUND

Vehicles such as maintenance trucks and construction equipment are known to be adapted for use on a railway by mounting high rail equipment on the vehicle in the form of additional wheels which are arranged to be supported on the rails. When braking however, known vehicles of this type generally rely on their conventional brakes normally used on roadways, which are not always sufficient when the vehicle is supported on the rails.

Other vehicles which are intended for use on railways such as trains have braking systems which are designed to directly engage the rails of the railway. These braking systems however are generally elaborate and complex arrangements which are intended to clamp the rails individually with considerable force. These systems can thus be costly to manufacture as well as costly to maintain for use with high rail equipment.

SUMMARY

According to one aspect of the present invention there is provided a braking system for rail equipment which is arranged to be supported on a pair of rails for movement in a longitudinal direction of the rails, the braking system comprising:

a pair of braking components, each having an upper brake block and a side brake block coupled substantially perpendicularly to the upper brake block;

rail equipment mounting means for mounting the pair of braking components laterally spaced apart on the rail equipment for alignment of each said braking component with a respective one of the rails;

braking component mounting means supporting the braking components on the rail equipment mounting means for movement relative to the rail equipment mounting means downward and laterally outward from the rail equipment mounting means between an engaged position in which each side brake block faces laterally outward so as to be arranged to engage an inner side of the respective one of said rails and each upper brake block faces downward so as to be arranged to engage a top side of the respective one of said rails and a disengaged position in which the braking components are arranged to be disengaged from the respective rails; and actuating means for selectively urging both the upper and side brake blocks of each said braking component relative to the braking component mounting means downward and laterally outward towards the engaged position.

The braking system of the present invention provides a simple structure which can be easily adapted to various vehicles. The mounting of the braking elements for movement downward and laterally outward from the frame in addition to the use of actuating means acting thereon provides braking force to the rail equipment by frictionally engaging the top side of the rails in addition to providing a wedging action between respective inner sides of the pair of rails. This wedging action provides considerable braking force to the rail equipment mounting the braking system thereon using a braking system of relatively simple construction. The braking system is particularly suited for vehicles supported on high rail equipment.

The braking component mounting means may comprise a pair of housings supported on the rail equipment by the rail equipment mounting means, each housing mounting a respective one of the braking components thereon for sliding movement of both the upper and side brake blocks together relative to the housing along a respective axis extending laterally outward at a downward incline from the rail equipment from the disengaged position to the engaged position.

The actuating means preferably comprise at least one hydraulic piston cylinder associated with each said braking component. The hydraulic piston cylinder is preferably mounted between each housing and the respective braking component.

There may be provided a biasing member coupled between each housing and the respective braking component, the biasing member being arranged to urge the braking component towards the respective housing.

Preferably there is provided a stop mounted on each housing for engaging the respective braking component supported thereon for limiting the displacement of the braking component relative to the respective housing. The stops may be adjustably mounted on the respective housings for adjusting an amount of allowable displacement of each braking component in relation to the respective housing.

The side brake block and the respective upper brake block of each said braking component may be coupled together for simultaneous movement between the engaged and disengaged positions.

The upper and side brake blocks may be secured to the braking component mounting means with fasteners such that the brake blocks are selectively separable from the braking component mounting means for replacement.

When each said braking component extends between respective ends in the longitudinal direction of the rails, there may be provided a rail sweep mounted on each end of each braking component. Each rail sweep is preferably arranged to engage the top side of the respective rail in the engaged position for scraping debris from the rails.

Each of the upper and side brake blocks may comprise a plurality of brake pads spaced apart in the longitudinal direction of the rails.

The rail equipment mounting means may comprise a mounting frame arranged to be supported on the rail equipment and supporting the braking component mounting means on the mounting frame. The mounting frame can be adapted to mount onto various types of vehicles for providing a fixed support in which the braking elements can be mounted for movement in relation thereto.

The upper and side brake blocks of each said braking component are arranged preferably arranged to engage a respective top side and a respective inner side of a head of a respective one of said rails.

The mounting frame may be arranged to be supported on rail equipment which comprises a roadway vehicle having high rail equipment mounted thereon. Alternatively, the braking system may be adapted for use on rail equipment including trains and the like.

The mounting frame is preferably movable between a railway position in which the braking components are arranged to be supported adjacent the respective rails and a roadway position in which the braking components are spaced upwardly in relation to the railway position. This is particularly useful when used on a roadway vehicle for supporting the braking components in the roadway position when the vehicle is travelling on a roadway and not on rails.

BRIEF DESCRIPTION OF THE DRAWINGS

In the accompanying drawings, which illustrate an exemplary embodiment of the present invention.

DETAILED DESCRIPTION

Figure 1:
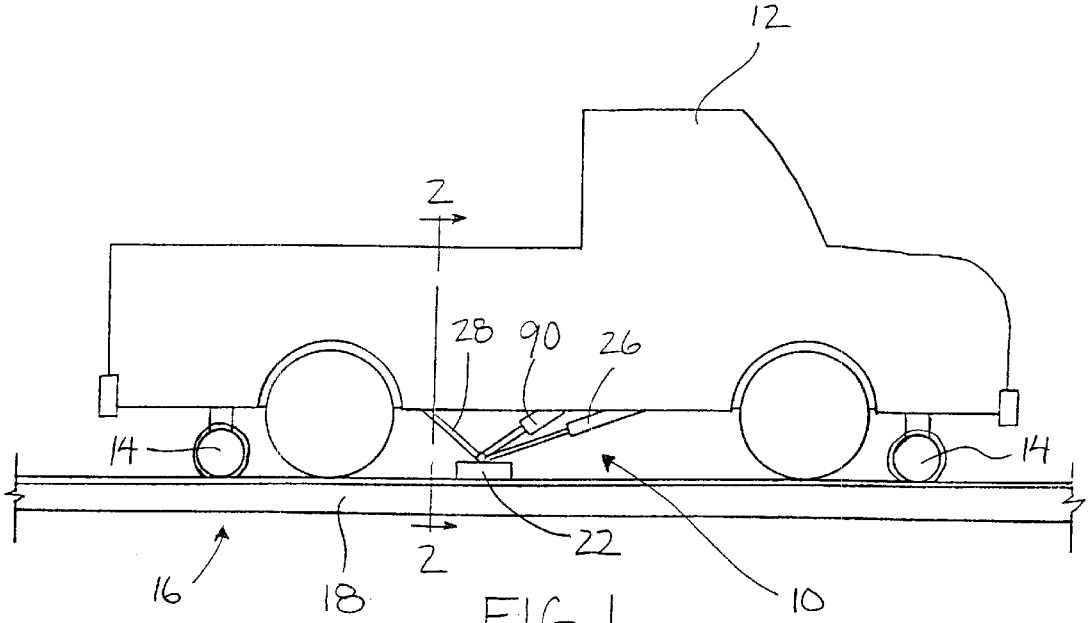
FIG. 1 is a side elevational view of the braking system mounted on a truck which has been equipped for rolling movement on a railway.
Figure 2:
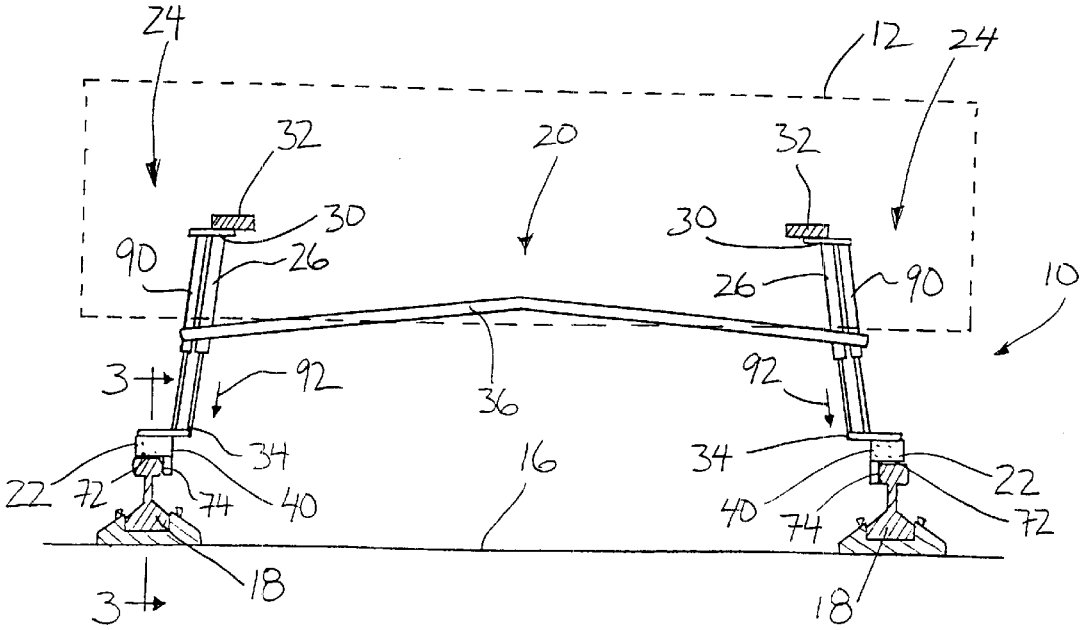
FIG. 2 is a partly sectional view along the line 2—2 of FIG. 1.
Figure 3:
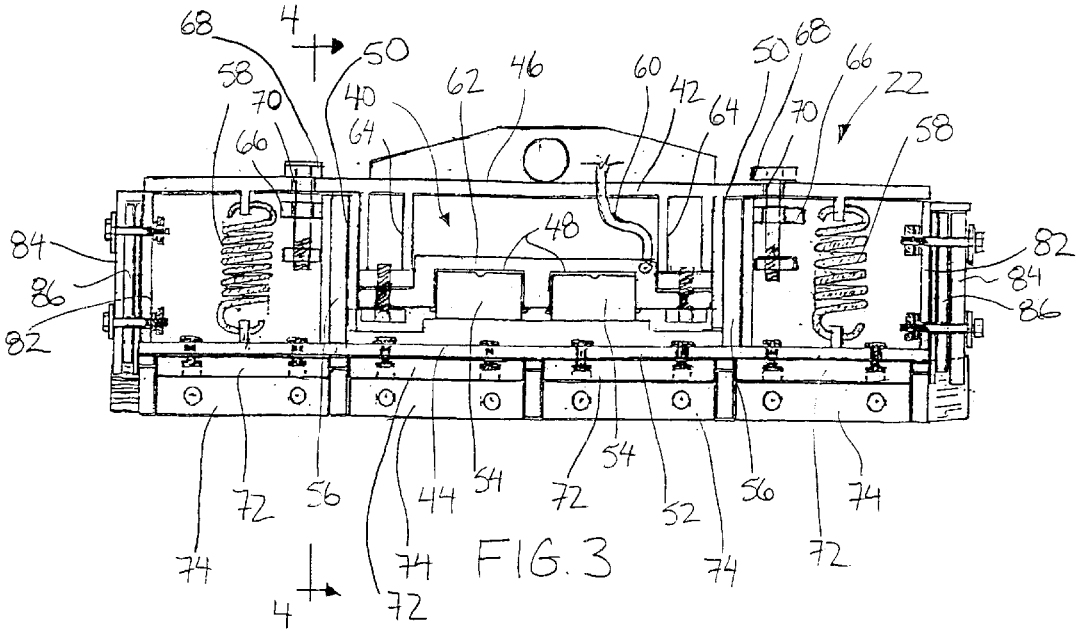
FIG. 3 is a sectional view of one braking element along the line 3—3 of FIG. 2.

Referring to the accompanying drawings, there is illustrated a braking system generally indicated by reference numeral 10. The braking system 10 is arranged for use with vehicles 12 which are supported on high rail equipment 14 for longitudinal rolling movement along a railway 16 comprising a pair of parallel and spaced apart rails 18.

The braking system 10 includes a mounting frame 20 which mounts a pair of braking elements 22 on the vehicle 12 so as to be laterally spaced apart transversely to the longitudinal direction of the vehicle 12. Each side generally indicated by reference numeral 24 of the mounting frame 20 mounts one of the braking elements 22 on a corresponding side of the vehicle 12.

Each side 24 of the mounting frame includes a front support arm 26 and a rear support arm 28. Both the front and rear support arms are pivotally mounted at respective top ends 30 on the frame 32 of the vehicle. The top ends 30 of the front and rear support arms are longitudinally spaced apart one in front of the other on the frame of the vehicle to extend downwardly and inwardly towards each other to respective bottom ends 34 which are coupled together.

Figure 5:
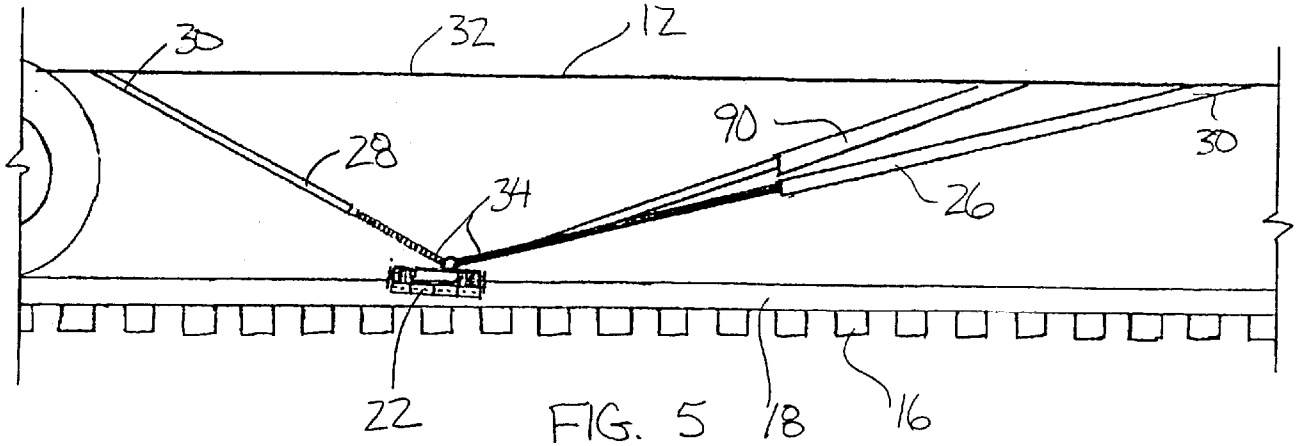
FIG. 5 is a side elevational view of the braking system in a railway position wherein the braking elements are positioned adjacent the respective rails of the railway when the vehicle is supported on the rails.
Figure 6:
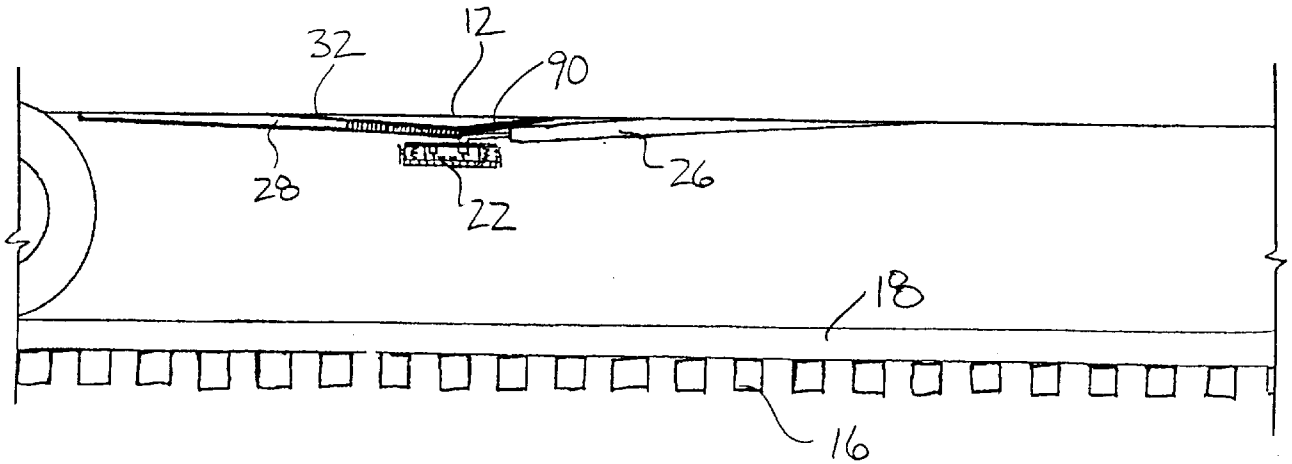
FIG. 6 is a side elevational view of the braking system in a roadway position wherein the braking elements are raised upwardly in relation to the railway position for use of the vehicle on a roadway.

The front support arm 26 is a telescoping member which permits adjustability of the length thereof such that the bottom ends 34 of the front and rear support arms can be pivoted upwards from a railway position as shown in FIG. 5 for use on a railway, to a roadway position as shown in FIG. 6 for use on a roadway. The rear support arm 28 comprises first and second sections wherein the second section is threadably received within the first section to permit adjustment of the length thereof in controlled amounts for controlling the position of the bottom ends 34 of the arms in the railway and roadway positions.

The front and rear support arms 26 and 28 are constrained to pivot within a fixed longitudinally extending plane which is inclined from vertical to extend downwardly and laterally outwardly from a position spaced laterally between respective sides of the vehicle. A cross support arm 36 is coupled between the respective front support arms 26 of opposing sides of the vehicle for additional support. The mounting frame provides a fixed frame in the railway position for supporting the braking elements adjacent the rails at a fixed spacing therefrom.

The braking elements 22 are mounted on the respective bottom ends 34 of the support arms of each respective side 24 of the mounting frame. The braking elements 22 are pivotally mounted on the respective support arms for movement therewith between the respective railway and roadway positions.

The braking elements 22 each include a housing 40 having an upper portion 42 anchored on the support arms and a lower portion 44 which is mounted on the upper portion 42 for sliding movement therebetween along respective axes extending downward and laterally outward in relation to the vehicle.

The upper portion 42 comprises a top plate 46 which supports a pair of downwardly facing cylinders 48 on a bottom side thereof as well as a pair of channels 50 extending downwardly therefrom.

The lower portion 44 includes a lower plate 52 which is substantially parallel and spaced below the top plate 46 of the upper portion. The lower plate 52 mounts a pair of pistons 54 thereon which are aligned with and received within the respective cylinders 48 of the upper portion 42. A pair of upright guide plates 56 extend upwardly from the lower plate 52 for alignment with the respective channels 50 in the upper portion of the housing so as to support the lower portion 44 for sliding movement in the channels 50 relative to the upper portion 42. An inclined sliding guide block 55 is mounted between the guide plates 56 and the channels 50 to support the guide plates for sliding movement constrained along respective axes which extend downwardly and laterally outwardly in relation to the vehicle as indicated by reference numeral 57.

A pair of helical springs 58 are mounted between the top plate 46 and the lower plate 52 at opposing ends of the housing so as to bias the lower portion 44 of the housing upwardly adjacent the upper portion 42.

A hydraulic fluid line 60 supplies the cylinders 48 with hydraulic fluid above the pistons 54 so as to urge the pistons and the lower portion 44 of the housing downwardly relative to the upper portion of the housing when pressurized hydraulic fluid is received therein. The cylinders 48 and the porting to the cylinders from the hydraulic fluid line 60 are formed in a base member 62 which is bolted in position on a pair of mounting channels 64 on a bottom side of the top plate 46.

The guide plates 56 each include a stop member 66 adjacent a top end thereof. A stop bolt is fitted through the aperture in each stop member 66 and a corresponding aperture 70 in the top plate 46 for engaging the stop member 66 and limiting the downward travel of the lower portion 44 of the housing relative to the upper portion 42 as desired. The stop bolt 68 includes a nut which is threaded on a bottom end thereof spaced below the stop member 66 such that downward travel of the lower portion 44 of the housing is limited when the stop member engages the nut on the end of the stop bolt 68. By adjusting the position of the nut on the bolt by rotation of the nut on the threads of the bolt, the permissible amount of displacement between the upper and lower portions of the housing is controlled.

A bottom side of the lower plate 52 mounts an upper brake block 72 and a side brake block 74 thereon. The upper brake block 72 comprises a plurality of longitudinally spaced brake pads having a downwardly facing braking surface arranged to engage a top running side 76 of the head of the rail. The side brake block 74 extends downwardly from an inner side 78 of the upper brake block 72 at substantially right angles thereto such that the braking surface of the side brake block 74 faces laterally outwardly for engaging an inner side 80 of the head of the rail. The side brake block 74 also comprises a plurality of longitudinally spaced brake pads wherein the brake pads are mounted on the respective brake blocks by removable fasteners such that the brake pads are selectively separable from the housing 40 to replace the pads as needed when the pads wear out. The upper and side brake blocks 72 and 74 are fixed together on the lower plate 52 to be urged downwardly and outwardly together by the pistons 54 operating in the hydraulic cylinders 48 for engagement with the rails in an engaged braking position.

An upright end plate 82 is mounted on each respective end of the housing on the lower portion 44 thereof. Each end plate 82 has an outer rail sweep 84 and an inner rail sweep 86 bolted thereon to extend downwardly from the lower plate 52. The rail sweeps ride on the top side of the rails in the braking position to ensure that the rails are scraped clean of debris. The rail sweeps are arranged such that the outer rail sweep 84 is formed of rubber and extend downwardly further than the inner rail sweep 86 which is formed of a suitable metal.

A hydraulic piston cylinder 90 which is arranged to mount between the vehicle frame 32 and the respective bottom end 34 of the support arms such that one of the piston cylinders 90 is mounted on each side of the vehicle 12. Expansion and retraction of the hydraulic piston cylinder 90 acts to displace the bottom ends 34 of the support arms between the respective railway and roadway positions thus displacing the braking elements 22 towards and away from the respective rails 18.

The hydraulic piston cylinders 90 are arranged to urge the braking elements 22 along respective arcs which extend downwardly and laterally outwardly from each other from a position spaced laterally between the respective braking elements in the direction as indicated by arrow 92 for supporting the housings of the braking elements at a fixed spacing from the rails in the railway position.

Figure 4:
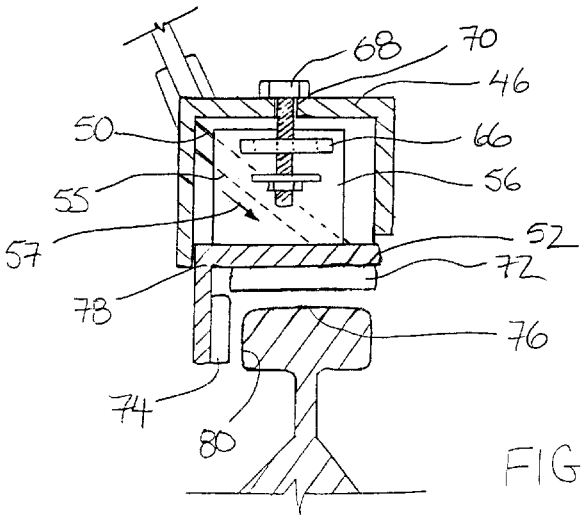
FIG. 4 is a sectional view of the braking element along the line 4—4 of FIG. 3.

The hydraulic pistons 54 act as actuators for displacing the brake blocks downwardly and outwardly along respective axes in relation to the respective housings between a disengaged position as shown in FIG. 4 and the engaged braking position wherein the brake blocks engage the respective rails. When the hydraulic pistons 54 are actuated, braking force is applied to the vehicle 12 by frictionally engaging the upper brake blocks with the respective top sides of the heads of the rails in addition to providing a wedging action of the side brake blocks engaging between the respective inner sides of the heads of the rails. The wedging action provides considerable braking force to the vehicle by pushing against opposing rails as opposed to clamping on a single rail.

When the vehicle is used on normal roadways, the braking elements 22 are retracted using the support arms 26 and 28 into the roadway position of FIG. 6. When the high rail equipment 14 is engaged for supporting the vehicle 12 on a railway 16, the braking elements 22 are subsequently displaced into the railway position adjacent to the respective rails at a fixed spacing therefrom. When braking force is desired to slow the vehicle down when rolling on the railway 16, the hydraulic actuators in the form of pistons 54 are activated to urge the brake blocks into firm engagement with the respective heads of the rails and to wedge the brake blocks between the respective inner sides of opposing rails.

In further variations of the present invention other fixed frames may be provided for mounting the braking elements 22 onto a vehicle 12 while permitting relative movement of the braking elements downwardly at a laterally outward incline to wedge between opposing inner sides of the respective rails. The braking elements 22 are thus adaptable to various types of rail equipment including maintenance trucks and construction vehicles having high rail equipment mounted thereon. Furthermore, the support arms may be replaced with a linkage arrangement for pivoting the braking elements downward and laterally outward along an arcuate path as opposed sliding movement along a fixed axis.

While one embodiment of the present invention has been described in the foregoing, it is to be understood that other embodiments are possible within the scope of the invention. The invention is to be considered limited solely by the scope of the appended claims.

What is claimed is:

1. A braking system for rail equipment which is arranged to be supported on a pair of rails for movement in a longitudinal direction of the rails, the braking system comprising:

a pair of braking components, each having an upper brake black and a side brake block coupled substantially perpendicularly to the upper brake black;

a rail equipment mounting mechanism for mounting the braking system on the rail equipment;

a braking component mounting mechanism supporting the braking components on the rail equipment mounting mechanism laterally spaced apart for alignment of each said braking component with a respective one of the rails:

the braking component mounting mechanism being supported for movement relative to the rail equipment mounting mechanism;

a first actuating mechanism for actuating movement of the braking component mounting mechanism relative to the rail equipment mounting mechanism downward and laterally outward from the rail equipment mounting mechanism between an engaged position in which each side brake block faces laterally outward so as to be arranged to engage an inner side of the respective one of said rails and each upper brake block faces downward so as to be arranged to engage a top side of the respective one of said rails and a disengaged position in which the braking components are arranged to be disengaged from the respective rails spaced upwardly in relation to the engaged position; and a second actuating mechanism for selectively urging both the upper and side brake blocks of each said braking component relative to the braking component mounting mechanism downward and laterally outward towards braking engagement with the rails.

2. The braking system according to claim 1 wherein the actuating mechanism comprises at least one hydraulic piston cylinder associated with each said braking component.

3. The braking system according to claim 1 wherein the braking component mounting mechanism comprises a pair of housings supported on the rail equipment by the rail equipment mounting mechanism, each housing mounting a respective one of the braking components thereon for sliding movement of both the upper and side brake blocks together relative to the housing along a respective axis extending laterally outward at a downward incline from the rail equipment into braking engagement with the rails.

4. The braking system according to claim 1 wherein the rail equipment mounting mechanism comprises a mounting frame arranged to be supported on the rail equipment and supporting the braking component mounting mechanism on the mounting frame.

5. The braking system according to claim 4 for rail equipment which comprises a roadway vehicle having high-rail equipment mounted thereon.

6. The braking system according to claim 5 wherein the mounting frame is movable between a railway position in which the braking components are arranged to be supported adjacent the respective rails and a roadway position in which the braking components are spaced upwardly in relation to the railway position.

7. A braking system for rail equipment which is arranged to be supported on a pair of rails for movement in a longitudinal direction of the rails, the braking system comprising:

a pair of braking components, each having an upper brake block and a side brake block coupled substantially perpendicularly to the upper brake block;

a rail equipment mounting mechanism for mounting the braking system on the rail equipment;

a braking component mounting mechanism supporting the braking components on the rail equipment mounting mechanism laterally spaced apart for alignment of each said braking component with a respective one of the rails;

the braking component mounting mechanism being supported for movement relative to the rail equipment mounting mechanism downward and laterally outward from the rail equipment mounting mechanism between an engaged position in which each side brake block faces laterally outward so as to be arranged to engage an inner side of the respective one of said rails and each upper brake block faces downward so as to be arranged to engage a top side of the respective one of said rails and a disengaged position in which the braking components are arranged to be disengaged from the respective rails spaced upwardly in relation to the engaged position;

the braking component mounting mechanism comprising a pair of housings, each housing mounting a respective one of the braking components thereon for sliding movement of both the upper and side brake blocks together relative to the housing along a respective axis extending laterally outward at a downward incline from the rail equipment; and an actuating mechanism for selectively urging both the upper and side brake blocks of each said braking component relative to the respective housing towards braking engagement with the rails;

the actuating mechanism comprising a hydraulic actuator mounted between each housing and the respective braking component.

8. The braking system according to claim 7, wherein there is provided a biasing member coupled between each housing and the respective braking component, the biasing member being arranged to urge the braking component towards the respective housing, away from braking engagement with the respective rail.

9. The braking system according to claim 7, wherein there is provided a stop mounted on each housing for engaging the respective braking component supported thereon to limit the displacement of the braking component relative to the respective housing.

10. The braking system according to claim 9, wherein each stop is adjustably mounted on the respective housing for adjusting an amount of allowable displacement of each braking component in relation to the respective housing.

11. A braking system for rail equipment which is arranged to be supported on a pair of rails for movement in a longitudinal direction of the rails, the braking system comprising:

a pair of braking components, each having an upper brake block and a side brake block coupled substantially perpendicularly to the upper brake block;

a rail equipment mounting mechanism for mounting the braking system on the rail equipment:

a braking component mounting mechanism supporting the braking components on the rail equipment mounting mechanism laterally spaced apart for alignment of each said braking component with a respective one of the rails;

the braking component mounting mechanism being supported for movement relative to the rail equipment mounting mechanism;

a first actuating mechanism for actuating movement of the braking component mounting mechanism relative to the rail equipment mounting mechanism downward and laterally outward from the rail equipment mounting mechanism between an engaged position in which each side brake block faces laterally outward so as to be arranged to engage an inner side of the respective one of said rails and each upper brake block faces downward so as to be arranged to engage a top side of the respective one of said rails and a disengaged position in which the braking components are arranged to be disengaged from the respective rails spaced upwardly in relation to the engaged position;

the braking component mounting mechanism comprising a pair of housings, each housing mounting a respective one of the braking components thereon for sliding movement of both the upper and side brake blocks together relative to the housing along a respective axis extending laterally outward at a downward incline from the rail equipment; and a second actuating mechanism for selectively urging both the upper and side brake blocks of each said braking component relative to the respective housing towards braking engagement with the rails;

the side brake block and the respective upper brake block of each said braking component being coupled together for simultaneous movement towards braking engagement with the rails.

12. The braking system according to claim 11, wherein the upper and side brake blocks are secured to the braking component mounting mechanism with fasteners such that the brake blocks are selectively separable from the braking component mounting mechanism for replacement.

13. The braking system according to claim 11 wherein each of the upper and side brake blocks comprises a plurality of brake pads spaced apart in the longitudinal direction of the rails.

14. The braking system according to claim 11 wherein the upper and side brake blocks of each said braking component are arranged to engage a respective top side and a respective inner side of a head of a respective one of said rails.

15. A braking system for rail equipment which is arranged to be supported on a pair of rails for movement in a longitudinal direction of the rails, the braking system comprising:

a pair of braking components, each having an upper brake block and a side brake block coupled substantially perpendicularly to the upper brake block;

a rail equipment mounting mechanism for mounting the braking system on the rail equipment;

a braking component mounting mechanism supporting the braking components on the rail equipment mounting mechanism laterally spaced apart for alignment of each said braking component with a respective one of the rails;

the braking component mounting mechanism being supported for movement relative to the rail equipment mounting mechanism downward and laterally outward from the rail equipment mounting mechanism between an engaged position in which each side brake block faces laterally outward so as to be arranged to engage an inner side of the respective one of said rails and each upper brake block faces downward so as to be arranged to engage a top side of the respective one of said rails and a disengaged position in which the braking components are arranged to be disengaged from the respective rails spaced upwardly in relation to the engaged position;

an actuating mechanism for selectively urging both the upper and side brake blocks of each said braking component relative to the braking component mounting means downward and laterally outward towards braking engagement with the rails;

each said braking component extending between respective ends in the longitudinal direction of the rails; and wherein there is provided a rail sweep mounted on each end of each braking component, each rail sweep being arranged to engage the top side of the respective rail in the engaged position for scraping debris from the rails.

* * * * *